United States Patent [19]

Lindenschmidt

[11] 4,043,624

[45] Aug. 23, 1977

[54] REFRIGERATION APPARATUS WALL STRUCTURE

[75] Inventor: Robert E. Lindenschmidt, Evansville, Ind.

[73] Assignee: Whirlpool Corporation, Benton Harbor, Mich.

[21] Appl. No.: 602,762

[22] Filed: Aug. 7, 1975

Related U.S. Application Data

[63] Continuation-in-part of Ser. No. 433,070, Jan. 14, 1974, Pat. No. 3,916,658.

[51] Int. Cl.[2] ..... F25D 11/00; A47B 81/00

[52] U.S. Cl. ..... 312/214; 220/9 F; 52/631

[58] Field of Search ..... 312/214, 330 SM; 52/631; 220/9 F, 62

[56] References Cited

U.S. PATENT DOCUMENTS

| | | | |
|---|---|---|---|
| 2,133,951 | 10/1938 | Ashbaugh | 312/214 |
| 2,139,779 | 12/1938 | Stratton | 312/214 |
| 2,555,788 | 6/1951 | Donaldson | 312/214 |
| 3,014,611 | 12/1961 | Marshall | 220/9 F |
| 3,070,253 | 12/1962 | Brown | 220/9 F |
| 3,152,199 | 10/1964 | Roberts | 312/214 |
| 3,177,271 | 4/1965 | Slayman | 312/214 |
| 3,496,689 | 2/1970 | Nerem | 52/631 |
| 3,601,463 | 8/1971 | Watt | 312/214 |
| 3,607,134 | 9/1971 | McIntyre | 220/9 F |
| 3,684,342 | 8/1972 | Jansen | 312/214 |
| 3,731,449 | 5/1973 | Kephart, Jr. | 52/631 |
| 3,794,396 | 2/1974 | Vick | 312/214 |
| 3,865,448 | 2/1975 | Winterheimer | 312/214 |

FOREIGN PATENT DOCUMENTS

| | | | |
|---|---|---|---|
| 1,401,603 | 10/1968 | Germany | 312/214 |
| 101,898 | 3/1963 | Norway | 312/214 |

*Primary Examiner*—Paul R. Gilliam
*Assistant Examiner*—Victor N. Sakran
*Attorney, Agent, or Firm*—Wegner, Stellman, McCord, Wiles & Wood

[57] ABSTRACT

A refrigeration apparatus enclosure and method of forming the same wherein an inner laminate wall is provided in an outer cabinet for providing the sheet liner and insulation portions of the refrigeration apparatus enclosure. The laminate wall is folded along lines cut through the insulation to conform to the configuration of the outer cabinet and insulation is provided for filling the resultant voids to complete the enclosure construction. The voids may be filled by foam blocks which may be cemented in place to aid in bonding the laminate wall to the outer cabinet. The rear wall of the cabinet may comprise a flat laminate wall and a divider wall may be provided within the cabinet for dividing the space therein into separate compartments. The divider wall may comprise a laminate wall and in one embodiment, comprises an extension of a laminate wall lining the cabinet. An improved deck construction may be provided formed of a notched laminate panel and defining an inclined rear portion. The notched laminate panel may further define upstanding side walls of the wall structure. A rear wall may be formed of a laminate panel to extend between the rear edges of the upright legs of the deck structure above the notches in the panel. Another form of disclosed wall structure includes a first wall formed of a laminate panel and a second wall intersecting the first wall and being defined by a sheet liner and an insulation with the sheet liner terminating inwardly of the outer surface of the first wall. The first wall may further be defined by a laminate panel including an inner sheet liner and an outer insulation.

16 Claims, 17 Drawing Figures

23
21
44
44
12
36
38
49
48
50
40
37
24
11
42
35
40
44
44
27

60
43
42
45
38
60
26
29
46
59
57
58
39
29

42
45
6.
44
38
41
30
36
6.

30
12
13
29
45
49
48
51
56
50
37
54
52
35
51
11
29
45
30

410
414
412
413
411
418
416
415
12.
13.
448
458
449
437
438
442
423
424
431b
419
421
420
430
425
426
417
422
431
431c
431a
434
433
432
428
427
429
416
454
455
452
453
450
451
447
446
443
444
445
436
439
435

REFRIGERATION APPARATUS WALL STRUCTURE

CROSS REFERENCE TO RELATED APPLICATION

This application comprises a continuation-in-part of my copending application Ser. No. 433,070, filed Jan. 14, 1974, now U.S. Pat. No. 3,916,658 and entitled Refrigeration Apparatus Enclosure Structure.

BACKGROUND OF THE INVENTION

1. Field of the Invention

This invention relates to refrigeration appliances, and in particular to enclosures therefor.

2. Description of the Prior Art

In conventional refrigeration appliance cabinet constructions, an outer metal cabinet is provided having an inner liner which may conventionally be formed of plastic spaced inwardly therefrom to define a space in which is provided suitable insulation. The insulation may be in the form of fiberglass pads, and in one improved form, the insulation comprises foamed-in-place insulation. One such foamed-in-place refrigeration apparatus enclosure construction is shown in U.S. Pat. No. 2,962,183 of J. C. Rill, Jr., et al. Such foamed-in-place cabinet constructions are relatively costly as they utilize separate liner elements, relatively costly preparations for the foaming operation, and costly fixtures for accurately retaining the cabinet and liner elements during the foaming operation. The liners are relatively expensive in that they require relatively costly tooling and processing steps, and the cost problems of such conventional foamed-in-place construction are aggravated where a number of different size models must be provided.

One attempted solution to this problem is that shown in U.S. Pat. No. 3,635,536 of Robert Lackey et al. wherein a portable refrigerator is shown as having a low cost cabinet utilizing a foam slab box having integral sides formed of a single sheet of foamed plastic. This patent teaches that if the foamed plastic is formed in a chilled mold process, coating of the inner and outer sides of the sheet may be omitted as the plastic is thusly formed with a thick impervious skin. In the absence of such a molding process, metal vinyl-clad sheets of extremely thin gauge may be utilized as an outer facing material. The box sides are formed from a notched slab which permits folding to the box configuration. The notches comprise cut portions on the inside of the sheet permitting the thick slab to be folded inwardly to form the box sides.

Additional art which may be considered pertinent to the invention is that cited in the parent application Ser. No. 433,070 of which, as indicated above, this application comprises a continuation-in-part. Said art cited in the parent application includes:

| Patent No. | Patentee |
|---|---|
| 2,317,775 | King |
| 2,493,958 | Foerstner |
| 2,576,665 | Bixler |
| 2,779,066 | Gaugler et al |
| 3,014,611 | Marshall |
| 3,367,492 | Pratt et al |
| 3,684,342 | Jansen |

Different means for forming machinery compartments of refrigeration apparatus cabinets are disclosed in the additional prior art patents of Keith K. Kesling U.S. Pat. No. 3,409,976, Albert Stimagmiglio U.S. Pat. No. 3,588,214, and Joshua Wilson Kitson U.S. Pat. No. 3,707,243.

SUMMARY OF THE INVENTION

The present development comprehends an improved refrigeration apparatus enclosure construction including an outer cabinet, an inner laminate wall within the outer cabinet defined by an inner sheet liner and outer insulation extending between the inner sheet liner and the outer cabinet, the inner liner having folded corner portions to conform the laminate to the contours of the outer cabinet, the insulation being cut through at the folded portions to define voids outwardly of the folded liner portions, and insulation means filling the voids.

The development further comprehends a method of constructing such a refrigeration apparatus enclosure including the steps of fabricating an outer cabinet, providing a flat laminate of sheet liner and insulation, slitting the insulation along lines corresponding to the corners of the outer cabinet, folding the sheet liner at the slits with the sheet liner disposed inwardly, fitting the folded laminate within the outer cabinet with the outwardly disposed insulation confronting the inner surfaces of the cabinet, and securing the laminate to the outer cabinet.

The insulation means may define means for bonding the laminate wall to the outer cabinet and in the illustrated embodiment, comprises preformed blocks of insulation material. The laminate wall may be bonded to the outer cabinet by suitable bonding means as desired.

The development may be utilized to provide a multiple compartment enclosure including a divider wall between a pair of U-shaped laminate walls defining a pair of refrigeration chambers within the cabinet. The divider wall may further comprise a laminate wall, and in one form of the invention, comprises an integral extension of one of the U-shaped laminate walls.

The rear wall of the enclosure may comprise a laminate wall with the rear edge of the U-shaped walls butted thereto. The inner sheet liner is effectively spaced from the outer cabinet by the insulation of the laminate wall construction to provide desired insulation between the liner and outer cabinet. The divider wall may be mounted in the manner of a shelf on suitable brackets provided on the U-shaped walls.

The outer insulation of the laminate wall may include an outer vapor barrier portion. The laminate wall insulation may comprise a rigid urethane foam and the inner sheet liner may be formed selectively of plastic or sheet metal as desired. A bead of suitable material, such as adhesive sealant, gasket, or caulking material, etc., may be utilized to seal the seams between the inner sheet liner portions within the enclosure.

The present invention comprehends a further improvement in the cabinet construction development wherein the lower portion of the refrigeration apparatus cabinet wall is defined by a wall structure including a generally U-shaped wall formed of a unitary laminate panel defined by an inner sheet liner and an outer insulation, the panel having a first edge, a rear edge, a mid-portion defining the bight of the U-shaped wall, end portions defining the legs of the U-shaped wall, and connecting portions at opposite sides of the mid-portion connecting the mid-portion thereto, the insulation being parted at the connecting portion, the connecting portion being turned to define continuous sheet liner corners of the U-shaped wall, the panel further having notches in the rear edge at opposite sides of the mid-portion, the insulation being further parted along a line between the forward ends of the notches and the liner being turned along the line to define an inclined rear portion of the bight extending substantially between the legs.

The wall structure may further include a rear wall formed of a flat laminate panel having an outer insulation and an inner sheet liner, the rear wall extending between the rear edges of the legs above the notches.

In the illustrated embodiment, the notches are triangular. Voids are formed in the insulation extending forwardly from the notches to the front edge of the U-shaped wall and a void may be formed in the insulation extending along the rear edge between the notches.

In the illustrated embodiment, the liner may be turned along a line extending between the notches, and more specifically, may be turned at an angle of approximately 45°.

The inclined rear portion of the U-shaped wall bight may underlie the lower edge portion of the legs thereof at the notches.

The rear edge of the sheet liner bight rear portion may abut the sheet liner of the rear wall, and the insulation thereat may define a void.

The present invention further comprehends an improved wall structure including a first wall formed of a laminate defined by an inner sheet liner and an outer insulation, and a second wall formed of a laminate intersecting the first wall, the second wall being defined by a sheet liner and an insulation, the second wall having an edge portion extending outwardly into the first wall, the liner of the edge portion terminating inwardly of the outer surface of the first wall insulation.

In the illustrated embodiment, the first wall comprises a vertical wall and the second wall comprises a horizontal wall.

The second wall insulation may extend fully to the outer surface of the first wall insulation or may be spaced substantially inwardly thereof, as illustrated in different embodiments herein.

The second wall insulation may overlie the first wall liner or may underlie the first wall liner, as illustrated in different embodiments herein. The liner of the second wall may terminate inwardly of the outer end of the insulation thereof or may coterminate therewith, as illustrated in different embodiments herein.

An outer cabinet may be disposed outwardly of the wall structure with the intersection of the walls defining an outer void inwardly of the outer cabinet.

In one embodiment herein, the outer cabinet may project at least partially into the void in spaced relationship to the outer end of the edge portion liner.

Thus, the refrigeration apparatus enclosure of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figure 1:
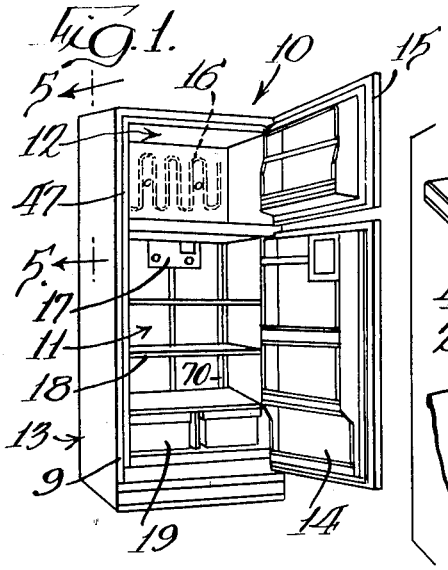
FIG. 1 is a perspective view of a refrigeration apparatus having an enclosure embodying the invention.

In the exemplary embodiment of the invention as disclosed in FIGS. 1-6 of the drawing, a refrigeration apparatus generally designated 10 illustratively comprises a refrigerator defining an above-freezing compartment 11 and a below-freezing compartment 12 defined by an insulated enclosure 13 provided with a pair of doors 14 and 15 for selectively closing chambers 11 and 12. The refrigeration apparatus may include conventional evaporator means 16, control means 17, shelves 18 supported by brackets 70, and drawer means 19. The present invention is concerned with the forming of the insulated enclosures 13, and as will be obvious to those skilled in the art, it may be utilized with other arrangements of refrigeration appliances, the refrigerator-freezer arrangements of FIGS. 1, 8 and 9 being illustrative only.

Figure 3:
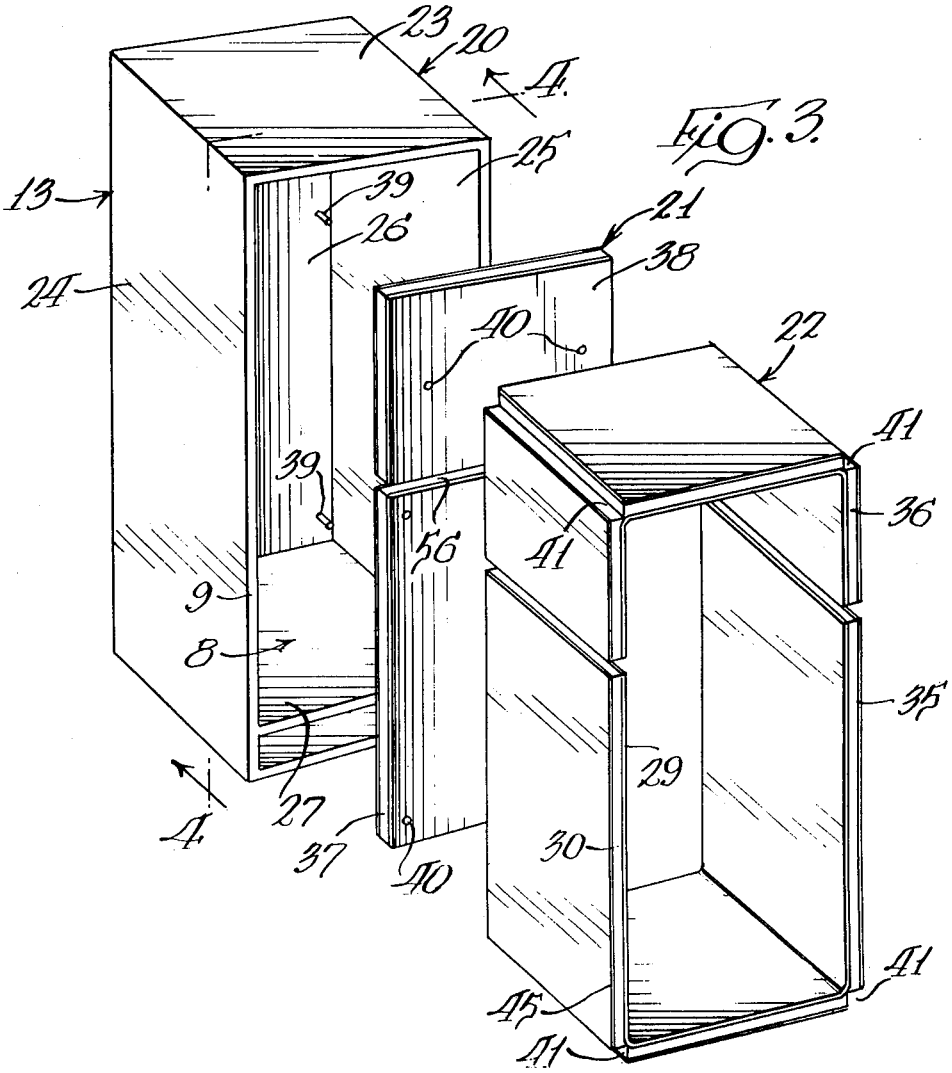
FIG. 3 is an exploded perspective view illustrating the arrangement of the laminate walls in constructing the enclosure of the invention.

Broadly, as shown in FIG. 3, the invention comprehends providing an enclosure 13 defined by an outer cabinet generally designated 20, rear wall means generally designated 21, and wall means 22 cooperating with rear wall means 21 to provide an insulative lining of the cabinet. The outer cabinet may be formed in a conventional manner from suitable material, such as metal, to define a forwardly opening box-like construction having a top wall 23, left sidewall 24, right sidewall 25, rear wall 26, bottom wall 27, and a flange 9 extending around the periphery of the front opening 8. Wall means 21 and 22 cooperatively provide an inner sheet liner means and a body of insulation between the inner sheet liner means and outer cabinet to form the completed enclosure 13.

Figure 2:
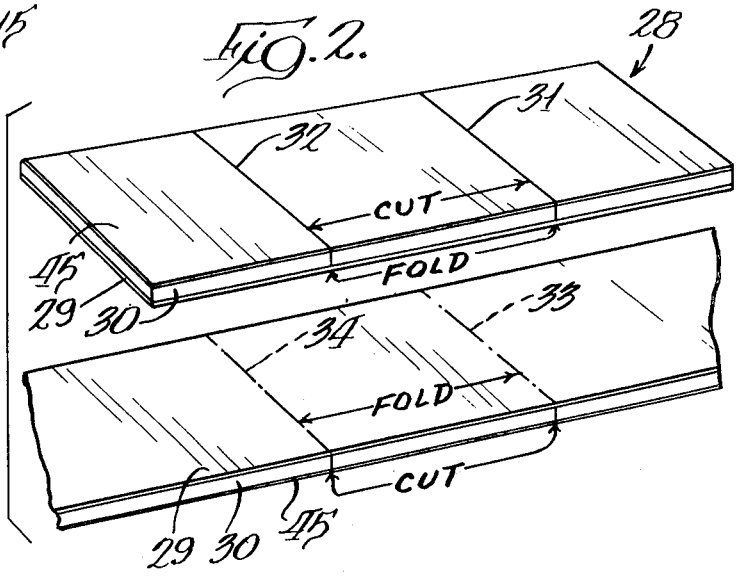
FIG. 2 is a fragmentary perspective view of a pair of laminate sheets illustrating the process of forming the same into laminate wall elements of the enclosure construction.

More specifically, as shown in FIG. 2, the laminate wall means 21 and 22 may be formed from a laminate sheet generally designated 28 defined by a flat sheet liner portion 29 of metal or plastic and a body of insulation 30 bonded between the sheet liner 29 and a thin plastic sheet 5 to form a laminate sandwich which may be provided in continuous length by suitable apparatus (not shown). At spaced intervals, the insulation is cut through such as at slits 31, 32, 33 and 34, permitting the sheet liner 29 to be folded along the insulation slit lines into a pair of U-shaped laminate wall elements 35 and 36 to define the laminate wall means 22. The flat laminate sheet 28 may be cut into discrete portions 37 and 38 to form the rear wall means 21, as shown in FIG. 3. As shown therein, the first laminate wall element 35 defines an upwardly opening U-shaped configuration and the second laminate wall element 36 defines a downwardly opening U-shaped configuration. The U-shaped configuration and slit insulation allow manipulation of the laminate past the flange 9 when inserting the elements into the cabinet 13 through front opening 8.

As further shown in FIG. 3, cabinet rear wall 26 is provided with a plurality of locating support posts 39 and rear laminate wall portions 37 and 38 are provided with a plurality of corresponding openings 40 for receiving the support posts both for locating the rear wall portions 37 and 38 in centered relationship to the walls 23, 24, 25 and 27 of the outer cabinet and for securing the laminate wall portions 37 and 38 to the rear wall 25 of the cabinet.

Figure 4:
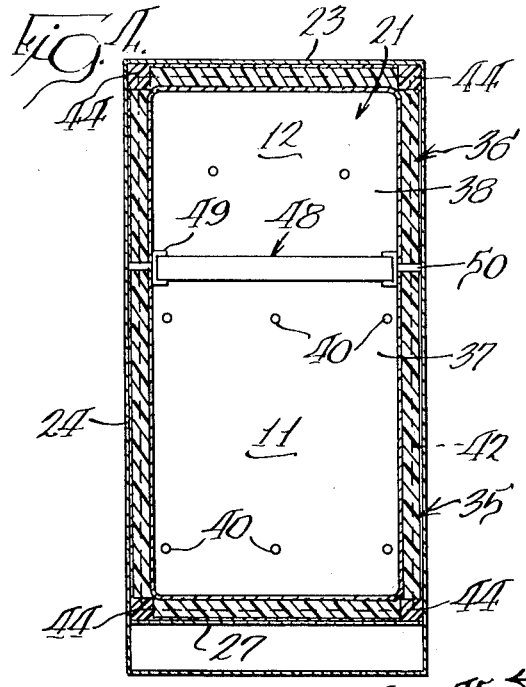
FIG. 4 is a vertical front section of the enclosure taken substantially along the line 4—4 of FIG. 3 after assembly and having a divider wall therein dividing the space within the cabinet into a pair of refrigeration chambers.
Figure 6:
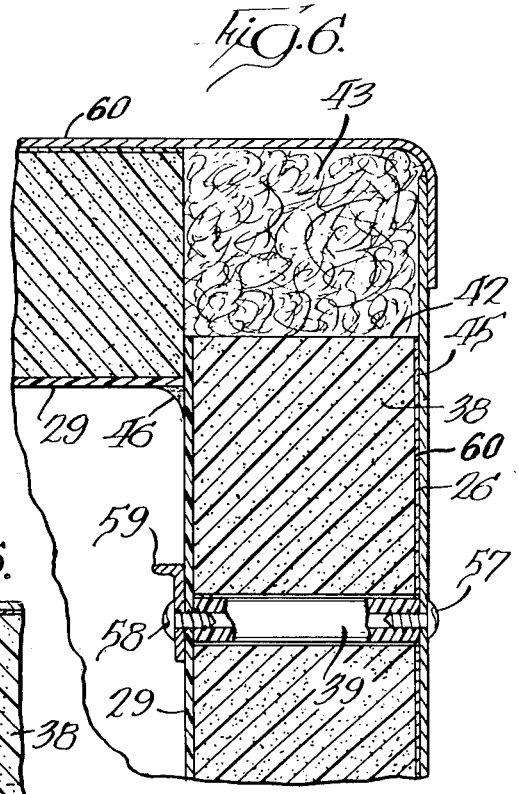
FIG. 6 is a vertical section taken substantially along the line 6—6 of FIG. 5.

As may be seen in FIG. 3, the folded corners of the U-shaped laminate wall elements 35 and 36 define voids 41. Further, as shown in FIG. 4, as the rear laminate wall portions 37 and 38 are spaced inwardly from the cabinet walls 23, 24, 25 and 27, respectively, a peripheral void 42 extends fully about the rear laminate wall means 21. In the illustrated embodiment, void 42 is filled with fiberglass insulation 43, as shown in FIG. 6, which may be installed therein prior to the installation of the U-shaped wall elements 35 and 36. By utilizing the separate openingly confronting U-shaped elements 35 and 36, different insulation thicknesses in the insulation means of the refrigeration and freezer compartments of the enclosure 13 may be provided. Further, as seen in FIG. 4, laminate wall elements 35 and 36 may be maintained spaced apart to provide a thermal break in the resultant space 50 between the two compartments.

Figure 5:
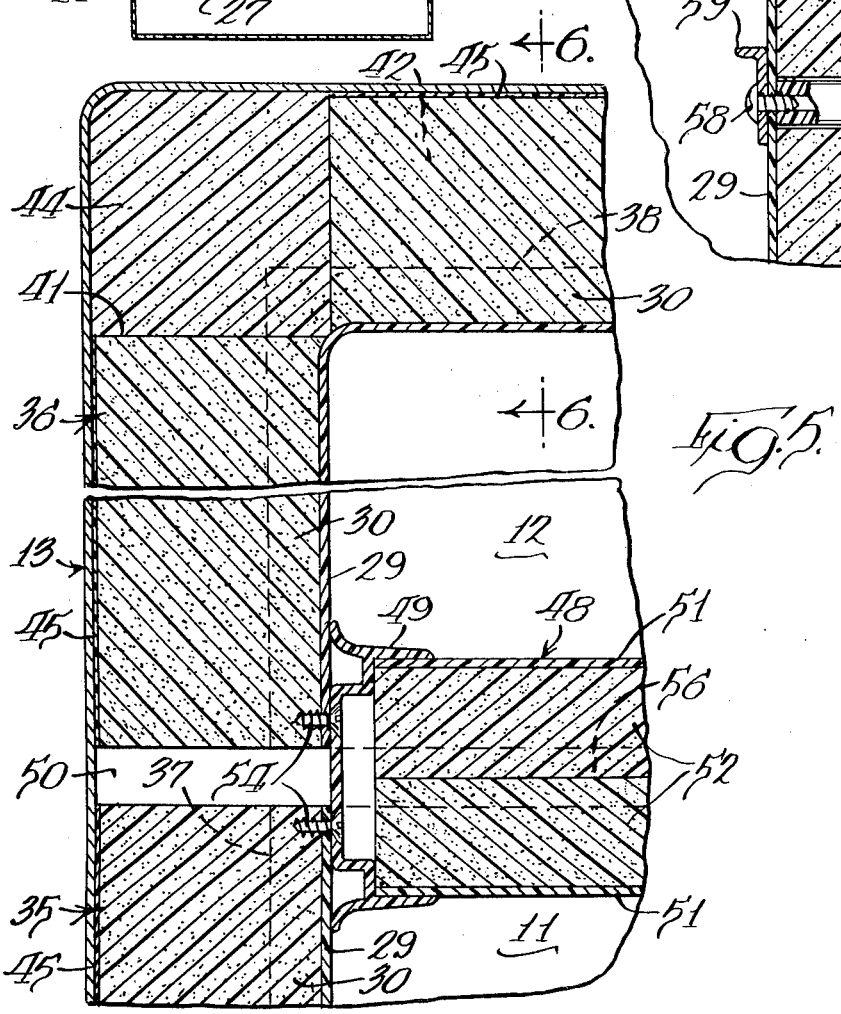
FIG. 5 is a fragmentary enlarged vertical section taken substantially along the line 5—5 of FIG. 1.

As shown in FIG. 5, the voids 41 may be filled with insulation 44. In the illustrated embodiment, insulation 44 comprises preformed blocks of insulation material, such as urethane foam, which may be suitably cemented in place as desired.

The laminate walls may further be bonded to the cabinet walls by suitable bonding adhesive as desired. In the illustrated embodiment, the plastic sheet 45 of the laminate walls functions as an outer vapor barrier.

As illustrated in FIG. 6, a bead of flexible adhesive sealant 46 may be laid along the seams between the sheet liner portion of the U-shaped laminate wall elements 35 and 36 and the front surface of the rear laminate wall portions 37 and 38.

Conventional breaker strip trim 47 may be assembled onto the U-shaped wall elements 35 and 36 and flange 9, as shown in FIG. 1.

As best seen in FIGS. 4 and 5, the compartments 11 and 12 are separated by a divider wall, or mullion, 48 which is retained between the sidewalls of the enclosure by means of a channel bracket 49 secured to sheet liner 29 of upper U-shaped wall element 36 and sheet liner 29 of lower U-shaped wall element 35 adjacent gap 50 so as to straddle the gap and effectively close the same along the sidewalls of the enclosure. The channel bracket 49 further extends across the rear wall portions 37 and 38 to effectively close the gap 56 between these portions. Divider wall 48, as best seen in FIG. 5, may comprise a pair of laminate walls including a sheet liner portion 51 and insulation portion 52 to define a double laminate sandwich having top and bottom metal or plastic sheet liner wall portions exposed to the chambers 12 and 11, respectively. The bracket may be secured to the liners 29 by suitable fasteners, such as screws, 54. While the divider wall 48 effectively covers the gap 56 between the rear wall portions 37 and 38 as well as the gap 50 along the sidewalls of the enclosure, the top chamber 12 is effectively thermally insulated from the lower chamber 11 by the break in the laminate wall means.

Figure 8:
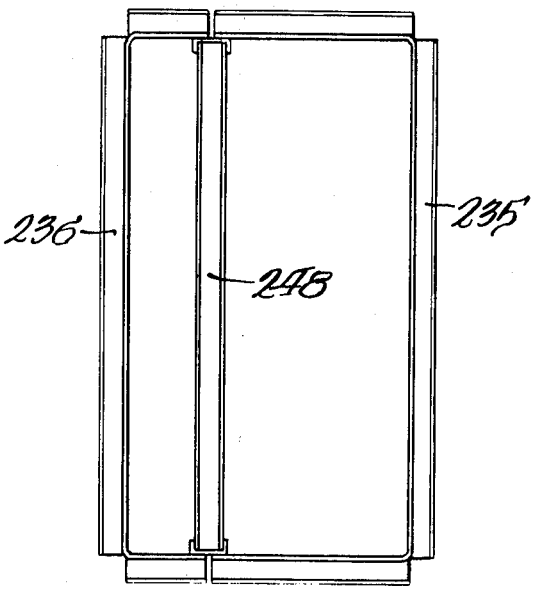
FIG. 8 is a front elevation illustrating the form of laminate wall arrangement for use in a side-by-side refrigerator-freezer.
Figure 9:
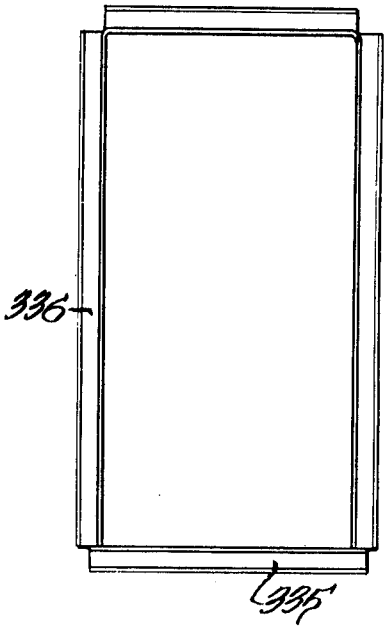
FIG. 9 is a front elevation illustrating the form of laminate wall arrangement for use in a vertical freezer.
Figure 7:
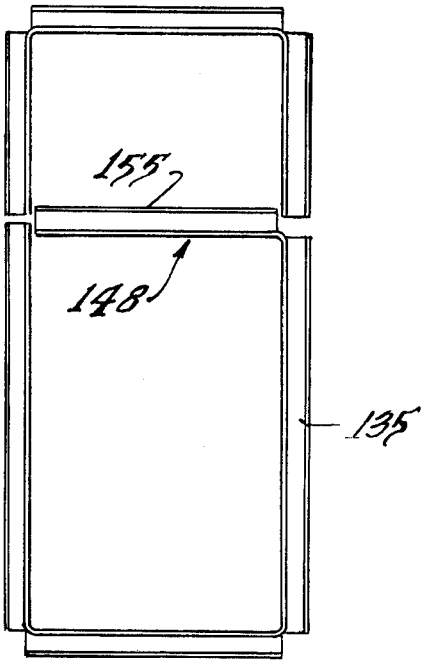
FIG. 7 is a front elevation illustrating a modified form of laminate wall arrangement for use in such a refrigeration apparatus enclosure.

In an alternative form, as shown in FIG. 7, the divider wall 148 may comprise an integral extension of the lower U-shaped laminate wall 135. A metal top plate 155 may be provided on the divider wall to cover the single thickness laminate sheet insulation. The form of the laminate structure for a side-by-side refrigerator-freezer is shown in FIG. 8. In this embodiment, the two U-shaped elements are horizontally opposed with element 235 in the above-freezing compartment and element 236 in the below-freezing compartment. Divider wall 248 separates the two compartments. For vertical freezers, the form of the laminate is shown in FIG. 9, wherein U-shaped element 336 conforms to the top and sides of the cabinet and portion 335 covers the bottom of the cabinet.

The mounting posts 39 for locating and mounting the rear wall portions 37 and 38 may comprise plastic posts secured to the outer cabinet by suitable fastening means such as screws 57, and to the inner sheet liner 29 of the rear laminate wall portions by suitable means such as screws 58. The screws 58 may further serve to mount support brackets 59 or shelf brackets 70 to the sheet liner as for carrying respectively the evaporator 16 or the shelves 18 in the enclosure.

Referring now to the embodiment of FIGS. 10-14, a modified form of refrigeration apparatus generally designated 410 comprises a refrigerator having an insulated enclosure 411 defining a pair of chambers 412 and 413 selectively closed by doors 414 and 415, respectively.

Figures 10, 11, 12:
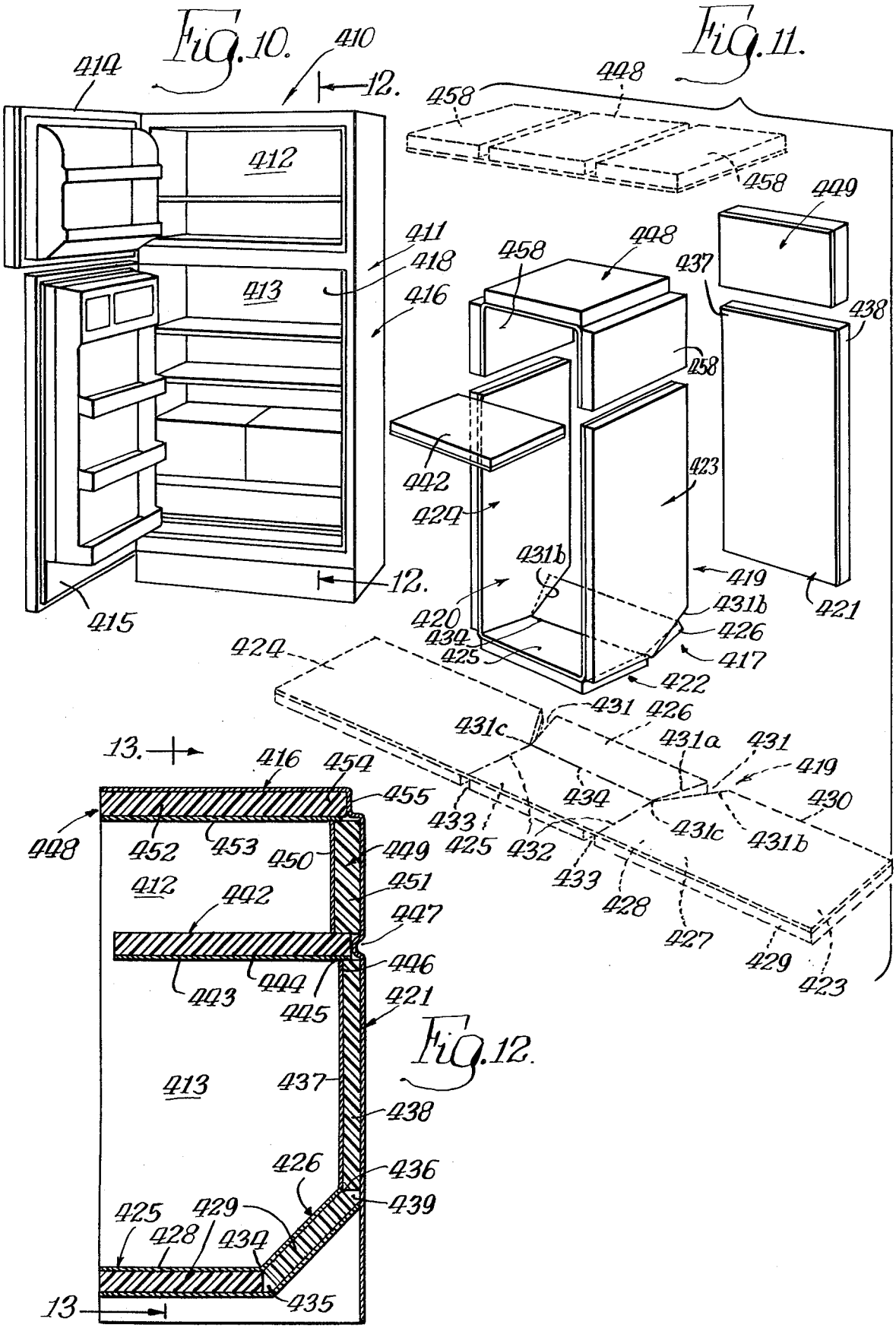
FIG. 10 is a perspective view of a refrigeration apparatus having a modified form of enclosure wall structure embodying the invention.
FIG. 11 is an exploded view illustrating the construction of the wall structure of FIG. 10.
FIG. 12 is a vertical section taken substantially along the line 12—12 of FIG. 10.

The enclosure 411 may include an outer cabinet 416 and an inner wall structure generally designated 417 (see FIG. 11). The inner wall structure defines the inner sheet liner 418 of the enclosure and the means for effectively insulating the enclosure.

As in the previous embodiments, the inner wall structure may be defined by laminate panels comprising a unitary construction of the inner sheet liner and insulation which may be formed continuously and suitably separated into suitable portions to define the different constituent elements of the inner wall structure 417.

In one form, the present invention more specifically is directed to the improved lower inner wall structure generally designated 419 which includes a generally U-shaped wall 420 and a flat rear wall 421. The U-shaped wall further includes a bight portion generally designated 422 and upstanding leg portions 423 and 424.

The bight portion is further subdivided into a horizontal front portion 425 and an angularly extending rear portion 426. Thus, as shown in FIG. 11, the bight 422 defines a beveled deck.

As shown in dotted lines in FIG. 11, the lower inner wall structure 419 may be formed from a continuous laminate panel 427 including an inner sheet liner portion 428 and an outer insulation portion 429. A rear edge 430 of the laminate panel may be provided with a pair of notches 431 extending forwardly to a pair of fold lines 432. The insulation may be parted as at voids 433 underlying the fold lines 432.

As shown in FIG. 11, the notches 431 may include an inner edge 431*a* extending at a small angle to the fold lines 433 and an outer edge 431*b* extending at a substantially larger angle thereto, such as approximately 45° thereto.

A third fold line 434 extends between the forward ends 431*c* of the notches 431 to divide the laminate panel between lines 432 and notches 431 into the forward wall structure portion 425 and inclined wall structure portion 426. As seen in FIG. 12, the insulation 429 may be parted underlying fold line 434 to define a void 435 when the rear portion 426 is turned to underlie the edges 431*b* of the legs 423 and 424, respectively, in the U-shaped arrangement of the lower inner wall structure 419.

As further shown in FIG. 12, the rear edge 436 of the liner 428 abuts the front surface of the rear wall 421. Rear wall 421 may be formed of a similar laminate as wall 419 including an inner sheet liner 437 and an outer insulation 438. Thus, edge 436 abuts the front surface of liner 437 at the rear of space 412 with the wall portion 426 extending at the bevel angle upwardly from the bottom wall 425.

The insulation 429 terminates adjacent the rear edge 436 to define a void 439.

As indicated briefly above, the inner wall structure 417 may be received within the outer metal cabinet 416. The dimensions of the inner wall structure portions are preselected to permit the fitting of the inner wall structure readily into the outer cabinet to define the insulated enclosure 411. The formation of the lower inner wall structure 419 is extremely simple, requiring merely the notching of the laminate panel to define the notches 431. The insulation 429 may be parted along the fold lines 432 as desired and, as shown in the illustrated embodiment, may be parted by the provision of cross grooves 433. The laminate panel is then simply folded along the fold lines 432 and 434 with the rear bottom wall portion 426 folded angularly upwardly to define the U-shaped wall structure 419, as shown in full lines in FIG. 11. The rear wall 421 may be inserted into the lower portion of cabinet 416 to the position shown in FIG. 12, and the U-shaped wall 420 inserted to complete the insulation of the lower portion of the inner wall structure.

The invention further comprehends an improved arrangement of the laminate panel wall structures wherein intersecting walls are defined by liner portions which do not extend fully to the outer cabinet and, thus provide improved insulating effect while yet permitting the construction of the inner wall structure from the low cost continuous laminate panel stock.

The concept of terminating the sheet liner short of the outer surface of the intersecting wall is illustrated in FIGS. 9 and 11–17.

Illustratively, in FIG. 12, a divider wall generally designated 442 may be provided to intersect rear wall 421 at the upper end of the rear wall. The divider wall may comprise a flat wall formed of the laminate panel and including a lower sheet liner portion 443 and an upper insulation portion 444. The rear edge 445 of the liner overlies the top edge 446 of the liner 437 of rear wall 421 but extends only partially outwardly therefrom toward the outer surface of the insulation 438. Thus, the liner edge 445 is effectively spaced inwardly of the metal cabinet wall 416 to provide improved insulation by preventing direct thermal transfer between the liner 443 and the outer metal cabinet wall 416.

As shown in FIG. 12, the outer metal cabinet wall 416 may be provided with a boss 447 engaging the insulation 444 to position the divider wall 442 as shown in FIG. 12 with the liner edge portion 445 spaced forwardly of the rear surface of the rear wall insulation 38.

As further shown in FIGS. 11 and 12, the inner wall structure may include an upper downwardly U-shaped inner wall structure generally designated 448 and an upper rear wall panel 449, each of which is similarly formed from similar laminate panel stock.

As shown in FIG. 12, the upper rear wall 449 may include an inner sheet liner portion 450 overlying the insulation 444 of divider wall 442, and an outer insulation portion 451 having a thickness somewhat greater than the thickness of the insulation portion 438 of the lower wall 421. The top wall portion 452 of the U-shaped wall 448 may include a sheet liner portion 453 overlying the upper edge of sheet liner portion 450 of upper rear wall 449 with the insulation portion 454 thereof extending outwardly into abutment with an inturned portion 455 of the cabinet wall 416 to maintain the sheet liner spaced inwardly of the outer cabinet wall to provide the desired maintained insulation therebetween similarly as between rear edge 445 of divider wall 442 and the outer cabinet.

Figure 13:
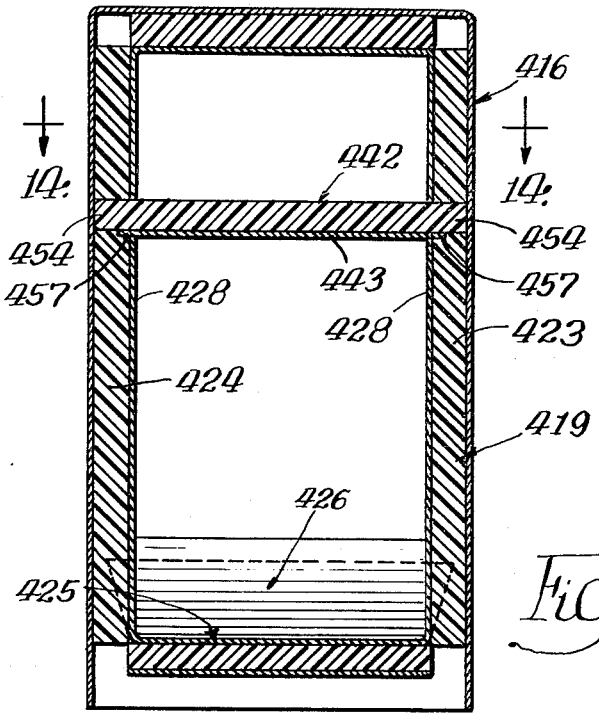
FIG. 13 is a vertical section taken substantially along the line 13—13 of FIG. 12.

As shown in FIG. 13, the divider wall 442 further defines lateral edge portions 456 overlying the legs 423 and 424 of the U-shaped lower wall structure 419. Thus, the sheet liner portion 443 extends outwardly beyond the sheet liner portions 428 of the lower wall and the insulation 454 extends beyond the sheet liner edge 457 to maintain the edge spaced inwardly of the outer cabinet 416.

Figure 14:
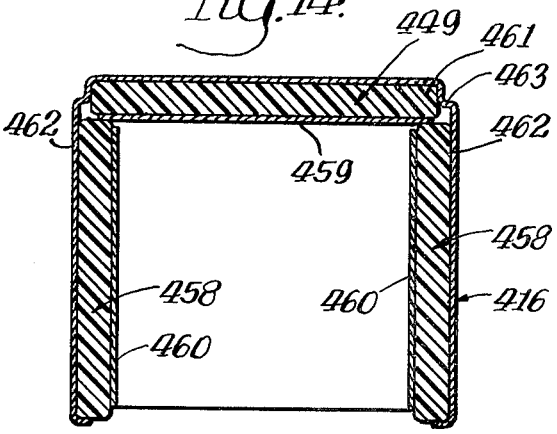
FIG. 14 is a horizontal section taken substantially along the line 14—14 of FIG. 13.

The back wall panel 449 intersects the sidewalls 458 of the top all 448 with the inner sheet liner 459 thereof extending beyond the inner sheet liner 460 of the top wall legs 458. As shown in FIG. 14, the insulation 461 of rear wall 449 may terminate inwardly of the outer surface 462 of the leg insulation portion 458 and may be substantially coterminous with the sheet liner portion 459. The cabinet wall 416 may be provided with an inwardly recessed corner portion 463 abutting the insulation 461 while remaining spaced from the sheet liner 459 for preventing direct thermal contact between the sheet liner and outer cabinet wall.

Figure 15:
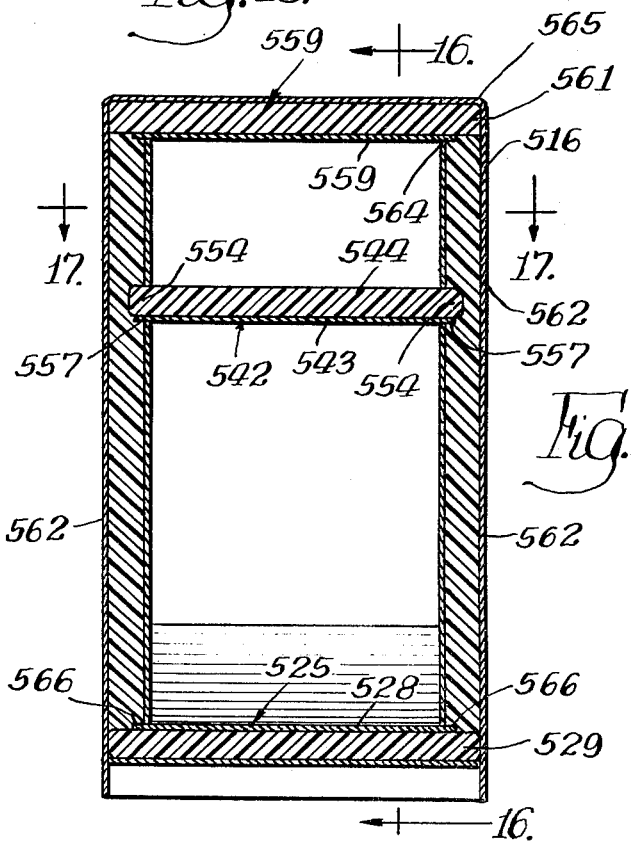
FIG. 15 is a vertical section of a further modified form of such wall structure.

In a modified form, as shown in FIG. 15, the top wall 559 may include an insulation portion 561 extending substantially beyond the edge 564 of sheet liner 559 with the cabinet 516 defining a rounded outer corner 565 whereby the insulation 561 extends substantially to the plane of the outer surface 562 of the vertical sidewalls of the cabinet construction.

As further shown in FIG. 15, the divider wall 542 may be provided with an insulation portion 544 having end portions 554 generally coterminous with the edge portions 557 of the sheet liner 542 thereof with both edge portions 554 and 557 terminating inwardly of the outer surface 562 of the sidewalls.

Further as shown in FIG. 15, the bottom wall portion 525 upper sheet liner 528 may have its lateral edges 566 terminate substantially inwardly of surfaces 562 with the insulation portion 529 thereof extending fully outwardly to the cabinet wall 516, and thus, substantially coplanar with the outer surfaces 562.

Figure 17:
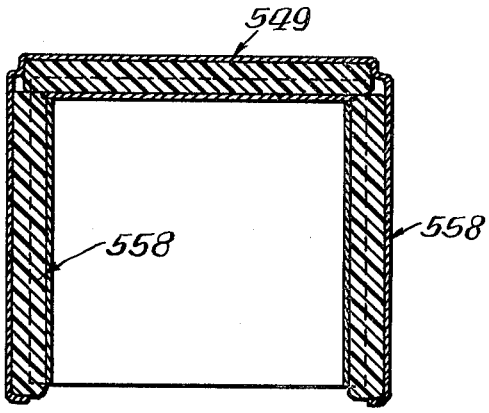
FIG. 17 is a horizontal section taken substantially along the line 17—17 of FIG. 15.

As shown in FIG. 17, the rear wall 549 may intersect the side walls 558 in a manner similar to the intersection of side walls 458 by rear wall 449 in cabinet construction 419.

Figure 16:
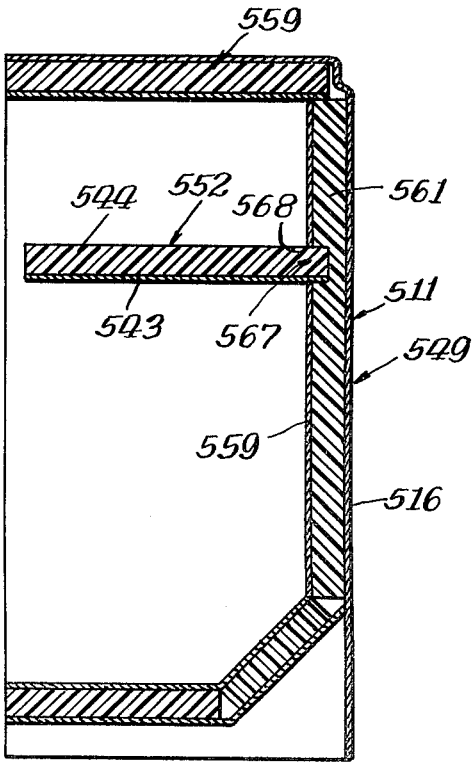
FIG. 16 is a vertical section taken substantially along the line 16—16 of FIG. 15.

As further shown in FIG. 16, the divider wall 552 may intersect the rear wall 549 with a rear edge portion 567 extending through an opening 568 in the inner sheet liner 559 and partially through insulation 561 thereof with the insulation 544 and sheet liner 543 thereof terminating coterminously in spaced relationship to the cabinet wall 516.

Top wall 559 may intersect the rear wall in a manner similar to that of the intersection of top wall 448 and rear wall portion 449 of cabinet construction 411.

Thus, the present invention comprehends a plurality of different wall constructions where intersecting wall sections are arranged to prevent direct thermal contact between an outer cabinet and the sheet liner of the intersecting wall. The sheet liner terminates inwardly of the outer surface of the insulation of the wall with which it intersects and, thus, inwardly of the outer cabinet enclosing the outer surface. In certain embodiments, the insulation of the laminate intersecting wall extends beyond the sheet liner edge, and in other embodiments, the insulation and liner edge are coterminous.

The use of the low cost, easily manufactured laminate panel stock in forming the different embodiments permits the manufacture of the insulated cabinet constructions in a simple and low cost manner. As the insulation is preformed in bonded association with the sheet liner portion of the laminate, expensive fixtures and the like normally required in the foaming of the insulation in place, as in conventional cabinet manufacture, are eliminated.

Thus, the invention comprehends improved simplified methods of constructing a refrigeration apparatus enclosure wherein a plurality of flat laminates defining an inner sheet liner and an outer insulation are provided. The laminates may be provided as separate panels or, alternatively, may be folded to conform to the internal configuration of the cabinet after firstly parting the insulation along the desired fold lines with the laminate elements being firstly cut from a continuous low cost laminate stock material. As indicated above, the stock material may include a vapor barrier as an outer portion of the insulation.

The use of the laminate construction permits adaptation of the internal construction of the enclosure to a wide variety of sizes and shapes of the refrigeration appliance enclosure. The enclosure arrangement is adapted for use with either hermetic or component hook-up refrigeration systems while yet providing the improved low cost construction of the insulated enclosure. As indicated above, adhesive means, such as adhesive 60, may be utilized to secure the laminate walls to the cabinet walls if desired.

The foregoing disclosure of specific embodiments is illustrative of the broad inventive concepts comprehended by the invention.

I claim:

1. A refrigerator apparatus wall structure comprising a generally U-shaped wall formed of a unitary laminate panel defined by an inner sheet liner and an outer insulation, said panel having a first edge, a rear edge, a mid-portion defining the bight of the U-shaped wall, end portions defining the legs of the U-shaped wall, and connecting portions at opposite sides of the mid-portion connecting said mid-portion thereto, said insulation being parted at said connecting portion, said connecting portion being turned to define continuous sheet liner corners of said U-shaped wall, said panel further having notches in said rear edge at opposite sides of said mid-portion, said insulation being further parted along a line between the forward ends of said notches and said liner being turned along said liner to define an inclined rear portion of said bight extending substantially between said legs.

2. The refrigeration apparatus wall structure of claim 1 wherein said notches are triangular.

3. The refrigeration apparatus wall structure of claim 1 wherein voids are formed in said insulation extending forwardly from the notches to said front edge.

4. The refrigeration apparatus wall structure of claim 1 wherein a void is formed in said insulation extending along said rear edge between said notches.

5. The refrigeration apparatus wall structure of claim 1 wherein said liner is turned along said line at an angle of approximately 45°.

6. The refrigeration apparatus wall structure of claim 1 wherein said inclined rear portion of said bight defines side edge portions underlying the lower edge portion of the legs defined by said notches.

7. A refrigeration apparatus wall structure comprising:

a generally U-shaped wall formed of a unitary laminate panel defined by an inner sheet liner and an outer insulation, said panel having a first edge, a rear edge, a mid-portion defining the bight of the U-shaped wall, end portions defining the legs of the U-shaped wall, and connecting portions at opposite sides of the mid-portion connecting said mid-portion thereto, said insulation being parted at said connecting portion, said connecting portion being turned to define continuous sheet liner corners of said U-shaped wall, said panel legs further having notches in the rear edge thereof at opposite sides of said mid-portion, said insulation being further parted along a line between the forward ends of said notches and said liner being turned along said line to define an inclined rear portion of said bight extending substantially between said legs; and a rear wall formed of a flat laminate panel having an outer insulation and an inner sheet liner, said rear wall extending between the rear edge of said legs above said notches.

8. The refrigeration apparatus wall structure of claim 7 wherein the rear edge of the sheet liner of said bight inclined rear portion abuts the sheet liner of said rear wall.

9. The refrigeration apparatus wall structure of claim 7 wherein the insulation of said bight inclined rear portion defines a void along the rear edge thereof and the rear edge of the sheet liner of said bight inclined rear portion abuts the sheet liner of said rear wall above said void.

10. The refrigeration apparatus wall structure of claim 7 wherein said rear wall defines a lower edge coplanar with the rear edge of the inclined rear portion.

11. The refrigeration apparatus wall structure of claim 7 wherein the side edges of said bight inclined rear portion underlie the lower edge portion of the legs defined by said notches, and the rear edge of the sheet liner of said bight inclined rear portion abuts the sheet liner of said rear wall.

12. A refrigeration apparatus wall structure comprising: a vertical wall including a first wall portion formed of a laminate defined by an inner sheet liner and an outer insulation and dfining an upper edge, and a second wall portion formed of a laminate defined by an inner sheet liner and an outer insulation and defining a lower edge above said upper edge of the first wall portion, said second wall portion having a thickness different from that of said first wall portion; and a horizontal wall formed of a laminate having an edge portion received between said spaced upper edge of the first wall portion and lower edge of the second wall portion, said horizontal wall being defined by a single sheet liner engaging the liner of only one of said vertical wall portions and terminating inwardly of the outer surface of the first vertical wall portion insulation.

13. The refrigeration apparatus wall structure of claim 12 wherein said horizontal wall edge portion insulation is spaced substantially inwardly of the outer surface of the first vertical wall portion insulation.

14. The refrigeration apparatus wall structure of claim 12 wherein the liner of said horizontal wall edge portion terminates inwardly of the outer end of the insulation thereof.

15. The refrigeration apparatus wall structure of claim 12 wherein the outer end of said horizontal wall edge portion liner and insulation coterminate at an outer plane.

16. A refrigeration apparatus wall structure comprising: a first wall formed of a laminate defined by an inner sheet liner and an outer insulation and defining an edge including a rectilinear front portion and a rectilinear rear portion extending at an angle to said front portion and a second wall formed of a laminate having a front portion defining an edge portion integrally connected to said front portion of the first wall edge, and a rear portion connected to said front portion of the second wall and having a rectilinear edge extending at an angle to said second wall front edge portion abutting said first wall edge rear portion.

* * * * *